US011761144B2

(12) United States Patent
Regier et al.

(10) Patent No.: US 11,761,144 B2
(45) Date of Patent: Sep. 19, 2023

(54) METHOD FOR FEEDING ITEMS OF LAUNDRY TO A MANGLE OR THE LIKE

(71) Applicant: Herbert Kannegiesser GmbH, Vlotho (DE)

(72) Inventors: Eduard Regier, Leopoldshöhe (DE); Manuel Kanne, Rinteln (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 0 days.

(21) Appl. No.: 17/739,500

(22) Filed: May 9, 2022

(65) Prior Publication Data

US 2022/0364296 A1 Nov. 17, 2022

(30) Foreign Application Priority Data

May 12, 2021 (DE) ..... 102021112392.5

(51) Int. Cl.
*D06F 67/04* (2006.01)
*D06C 3/00* (2006.01)

(52) U.S. Cl.
CPC ..... *D06F 67/04* (2013.01); *D06C 3/00* (2013.01)

(58) Field of Classification Search
CPC ..... D06F 67/00; D06F 67/04; D06C 3/00
See application file for complete search history.

(56) References Cited

U.S. PATENT DOCUMENTS 5,815,963 A 10/1998 Rauch
8,845,259 B2 * 9/2014 Nielsen ..... D06F 67/04 38/143
9,222,213 B2 * 12/2015 Garrone ..... D06F 67/04
2019/0301081 A1 10/2019 Nakamura
2019/0352840 A1 * 11/2019 Bringewatt ..... D06F 67/04
2020/0391957 A1 * 12/2020 Bringewatt ..... B65G 47/24

FOREIGN PATENT DOCUMENTS

DE 102006046239 A1 4/2008
DE 102017000620 A1 * 7/2018
WO 2007134601 A1 11/2007

OTHER PUBLICATIONS

Deutsches Patent—Und Markenamt (German Patent and Trademark Office), Recherchebericht (search in a related application), dated Feb. 8, 2022.

* cited by examiner

*Primary Examiner* — Ismael Izaguirre

(74) *Attorney, Agent, or Firm* — Laurence P. Colton; SMITH TEMPEL BLAHA LLC

(57) ABSTRACT

Laundry items are spread out by a spreading device during which a front edge of the laundry item is stretched out. Subsequently, a front edge strip of the stretched-out front edge is transferred onto a depositing strip which deposits the edge strip onto a feed conveyor which feeds it to a mangle. This front edge typically has a residual sag. In larger laundry items, the depositing strip can collide therewith as it moves down under the edge strip, impairing the mangling quality. Making provision to space the depositing strip from the edge strip, prior to the movement under the latter, to an extent that the edge strip does not collide with the depositing strip as the latter moves down results in the depositing strip accepting the edge strip with a rectilinear front edge and then the laundry item is fed to the mangle and inserted into the latter.

12 Claims, 5 Drawing Sheets

METHOD FOR FEEDING ITEMS OF LAUNDRY TO A MANGLE OR THE LIKE

CROSS REFERENCE TO RELATED APPLICATIONS

This patent application claims priority on and the benefit of German Patent Application No. 10 2021 112 392.5 having a filing date of 12 May 2021.

BACKGROUND OF THE INVENTION

Technical Field

The invention relates to a method for feeding items of laundry to a mangle or the like, with two adjacent corner regions of a front edge, running transversely with respect to the feeding direction, of the respective item of laundry being clamped in two adjacent spreading clamps of a spreading device, the front edge being stretched out by the spreading clamps holding the adjacent corner regions being moved apart and, in the process, the item of laundry being spread out and the item of laundry, with an edge strip emerging from the stretched-out front edge, being accepted onto a depositing region of a depositing strip, which is movable in and counter to the feeding direction and which transfers the item of laundry to a feed conveyor transporting the latter to the mangle or the like.

Prior Art

Items of laundry, specifically especially what are called flat items of laundry, such as bed linen and table linen, are supplied by what are referred to as insertion machines to a mangle or to another laundry machine, for example a folding machine. Here, a front edge, running transversely with respect to the feeding direction, of the respective item of laundry is stretched out or spread and, in the process, the item of laundry is spread out.

In order to stretch out the front edge of the item of laundry, insertion machines have a spreading device with at least one pair of spreading clamps consisting of two spreading clamps. The spreading clamps are movable apart in order to spread the front edge transversely with respect to the feeding direction. The stretching out of the items of laundry has to take place gently. For this purpose, the front edge is spread by the spreading clamps only until the sag of the front edge is merely approximately eliminated, such that a small residual sag remains.

Insertion machines are known in which an edge region emerging from the stretched front edge of the item of laundry, in particular edge strip, is first of all deposited onto a depositing region of a depositing strip and the item of laundry is transferred from the depositing strip with the edge region onto a feed conveyor which transports the spread-out item of laundry to the mangle or the like, preferably also inserts same into the mangle. In order to accept the respective item of laundry, the depositing strip is moved under the edge strip, which is still held stretched in front of the spreading clamps. In the case of this known insertion machine, during the moving down of the depositing region of the depositing strip under the edge strip, the residual sag of the front edge of the item of laundry comes into contact with a region of the front edge strip emerging from the lowest central point of the residual sag, as a result of which the sag is increased. With such an increased sag, the front edge of the item of laundry is then inserted into the mangle or the like, thus causing a deterioration in the quality of mangling since creases form or may form during the mangling.

BRIEF SUMMARY OF THE INVENTION

The invention is based on the object of providing a method for feeding items of laundry to a mangle or the like, the method leading to an improved quality of the mangling and in particular avoiding an increase in the sag of the front edge of the item of laundry during feeding of same to the mangle or the like.

A method for achieving this object is a method for feeding items of laundry to a mangle or the like, with two adjacent corner regions of a front edge, running transversely with respect to the feeding direction, of the respective item of laundry being clamped in two adjacent spreading clamps of a spreading device, the front edge being stretched out by the spreading clamps holding the adjacent corner regions being moved apart and, in the process, the item of laundry being spread out and the item of laundry, with an edge strip emerging from the stretched-out front edge, being accepted onto a depositing region of a depositing strip, which is movable in and counter to the feeding direction and which transfers the item of laundry to a feed conveyor transporting the latter to the mangle or the like, wherein in order to accept the respective item of laundry from the spreading clamps, at least one portion of the depositing strip is moved at a distance under at least the edge strip of the item of laundry. In this method, for accepting the item of laundry from the spreading clamps, the depositing strip is moved at a vertical distance under the front edge and/or the edge strip of the item of laundry. As a result, the depositing strip, as it moves counter to the feeding direction under at least the front edge, does not come into contact with the item of laundry. In particular, because of the residual sag, the central lowest point of the front edge and optionally the adjoining central region of the edge strip do not come into contact with the depositing strip when the latter is moved counter to the feeding direction at a vertical distance under the lowest point of the residual sag. As a result, it is no longer possible for the sag of the front, transversely directed edge of the item of laundry to be increased when the depositing strip moves down under the edge strip, running transversely with respect to the feeding direction, of the item of laundry.

It is preferred if the depositing strip is moved only with a depositing region, on which the edge region, in particular edge strip, of the respective item of laundry is to be deposited, at a distance under the edge strip of the item of laundry. This suffices to ensure that, when the depositing strip is moved down under the edge strip of the item of laundry, in particular the depositing region of the depositing strip does not touch the item of laundry, as a result of which the sag of the front edge of the item of laundry that is still held by the spreading clamps of the spreading device could be increased.

The method is preferably configured in such a manner that the depositing strip is moved at such a distance under the edge strip or edge region of the item of laundry that the depositing region, without touching the item of laundry, can be moved along under the lowest point of the residual sag of the front edge that is still present or remaining after the front edge has been stretched out. It is thus ensured that even the lowest point of the sagging edge only of the front edge strip adjoining the latter is not impaired by the depositing strip, in particular the depositing strip does not increase the sag during the transfer operation or accepting operation of the item of laundry.

As soon as at least the front depositing region of the depositing strip has moved at a distance under the edge strip of the item of laundry, specifically without touching the edge strip in the process, it is provided, according to an advantageous refinement possibility of the method, to at least reduce, preferably entirely to eliminate, the distance at least of the depositing region of the depositing strip from the front edge strip of the item of laundry. The front edge strip of the respective item of laundry is deposited here onto the depositing region of the depositing strip. The edge strip of the item of laundry passes here lying flat onto the depositing region of the depositing strip. The residual sag of the front edge of the item of laundry is not increased when the edge strip is deposited on the depositing region of the depositing strip.

The method can also be advantageously developed in such a manner that, after moving down the depositing region of the depositing strip under the front edge strip or edge region of the item of laundry, the distance of at least the depositing region of the depositing strip from the front edge strip of the item of laundry is reduced until the entire front edge of the item of laundry and the edge strip proceeding from it rest completely, preferably over the full surface area, on the depositing region of the depositing strip.

A preferred development possibility of the method is conceivable, in which, after moving down the depositing region of the depositing strip under the front edge region of the item of laundry, the distance at least of the depositing region of the depositing strip from the front edge region of the item of laundry is reduced until at least a large part, preferably at least 70%, of the front edge and/or of the front edge strip of the item of laundry lies on the depositing region. This prevents twisting of the item of laundry, in particular of the front edge strip of same when the adjacent corners of the front edge of the item of laundry are released from the spreading clamps. Since, at this point, a large part of the front edge strip is already resting on the depositing region of the depositing strip and it can optionally be fixed thereon by negative pressure, the item of laundry, when the spreading clamps are released, can no longer move or twist on the depositing region, which could lead to an undesirable creasing during the depositing of the edge strip on the depositing region of the depositing strip.

The method is preferably configured in such a manner that the distance at least of the depositing region of the depositing strip from the front edge strip or edge region of the item of laundry which is also held at adjacent corners of the front edge on spreading clamps of the respective pair of spreading clamps but is already spread is changed by pivoting or lowering with subsequent lifting of the depositing strip. It is thereby possible, before the moving down under at least the edge strip of the stretched-out item of laundry, to sufficiently space the depositing region of the depositing strip from the front edge and/or the edge strip in order thereby to ensure that even deeper residual sags of the front edge of large items of laundry are not influenced by the depositing strip.

According to an advantageous refinement possibility of the method, it is provided to pivot the depositing strip about a pivot axis which follows the depositing region in the feeding direction and lies downstream of the depositing region. As a result, when the depositing strip is pivoted about the pivot axis, the depositing region is lowered, and therefore the distance of the depositing region from the edge region which is still held by the spreading clamps, but is already stretched out, can be increased and can subsequently be reduced again by pivoting the depositing strip in the opposite direction.

Alternatively, it is conceivable not to increase and to reduce or to eliminate the distance of the depositing region from the edge strip by pivoting of the depositing strip, but rather by moving same up and down.

It is particularly advantageous, after the depositing of the edge strip of the item of laundry on the depositing region, to move the depositing strip, while maintaining its raised or upwardly pivoted position, in which it has accepted the item of laundry from the spreading clamps, together with the item of laundry in the feeding direction and then to transfer the item of laundry to the feed conveyor. Accordingly, the depositing strip or at least the depositing region thereof needs only to be lowered or pivoted downward before accepting the edge strip of the item of laundry from the spreading clamps. This respective movement has to be reversed after the edge strip is deposited on the depositing region of the depositing strip. The depositing of the item of laundry from the depositing strip onto the feed conveyor can then take place before or after the depositing strip is lowered or pivoted again.

BRIEF DESCRIPTION OF THE DRAWINGS

A preferred exemplary embodiment of the invention will be explained in more detail below with reference to the drawing, in which.

DETAILED DESCRIPTION OF PREFERRED EMBODIMENTS

The figures show by way of example a possible apparatus for carrying out the method according to the invention, namely an apparatus designed in the form of an insertion machine.

The apparatus which is shown serves for feeding stretched-out or spread-out items of laundry 10 to a mangle, not illustrated in the figures, or to another laundry treatment machine, for example a folding machine. The items of laundry 10 are preferably what are referred to as flat linen, especially bed linen and table linen.

Figure 2:
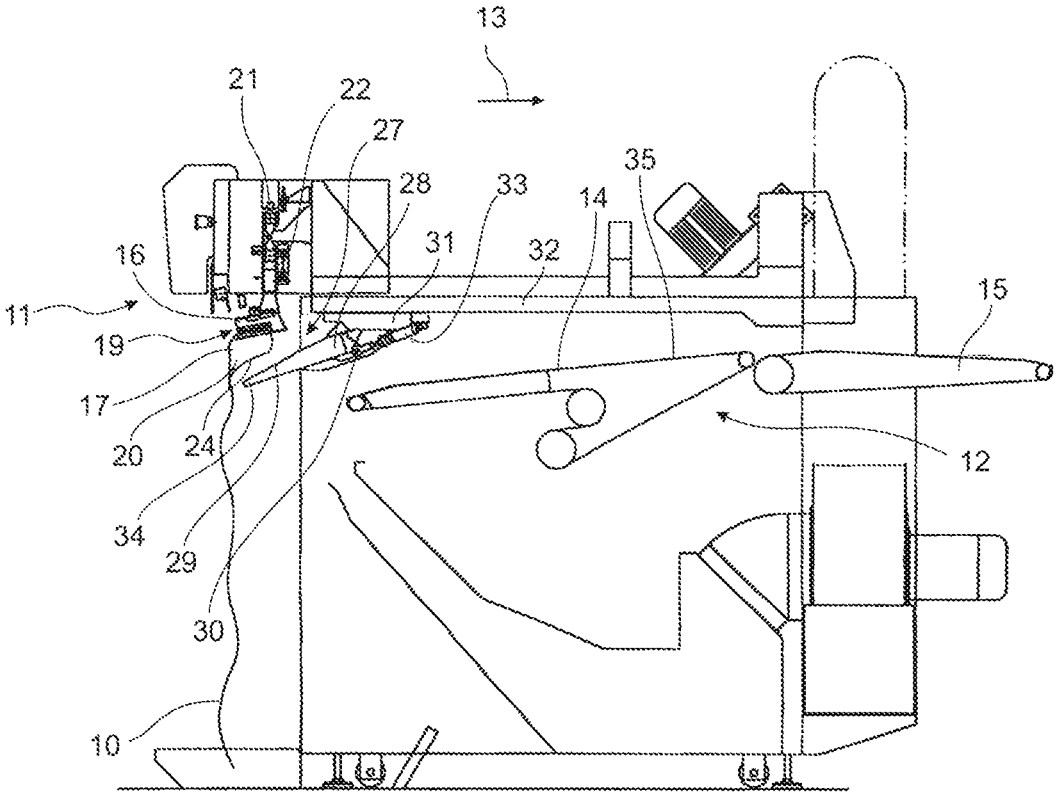
FIG. 2 shows a schematic side view of the insertion machine with a depositing strip shortly before receiving an item of laundry from spreading clamps.
Figure 3:
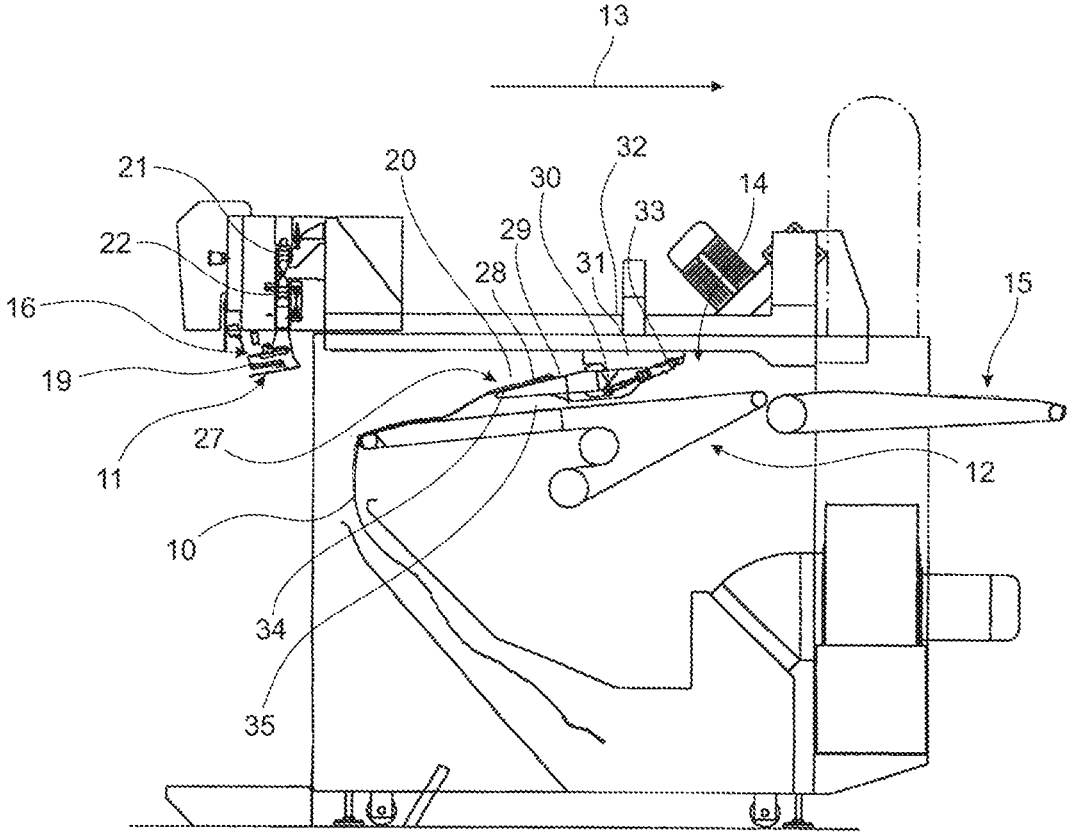
FIG. 3 shows a view of the insertion machine according to FIG. 2 before the depositing of a front edge strip of the item of laundry on a feed conveyor.

The apparatus essentially has a spreading device 11, a depositing strip 27 and at least one feed conveyor 12 which transports the respective item of laundry 10, which is spread out by the spreading device 11, in the feeding direction to the mangle or the like and/or inserts said item of laundry 10 into the latter. FIGS. 2 and 3 show a feed conveyor 12 which is formed from two belt conveyors 14 and 15 following one another in the feeding direction 13. It is conceivable for the feed conveyor 12 to have only a single belt conveyor 14 or more than two belt conveyors 14 and 15. The arrangement, the course and the design of the belt conveyors 14 and 15 may also differ from the exemplary embodiment of FIGS. 2 and 3.

The spreading device 11 has at least one pair of spreading clamps consisting of two preferably identical spreading clamps 16 which hold two adjacent corner regions, preferably corners 17, of a front edge 18, running transversely with respect to the feeding direction 13, of the respective item of laundry 10. Each spreading clamp 16 has a front, open clamp mouth 19 into which the corners 17 or corner regions of the front edge 18 of the item of laundry 10 can be pushed in the feeding direction 12. An opposite, rear end of each clamp mouth 19 is accordingly closed. This lower end of each clamp mouth 19 therefore lies on the side of the depositing strip 27.

Figure 1:
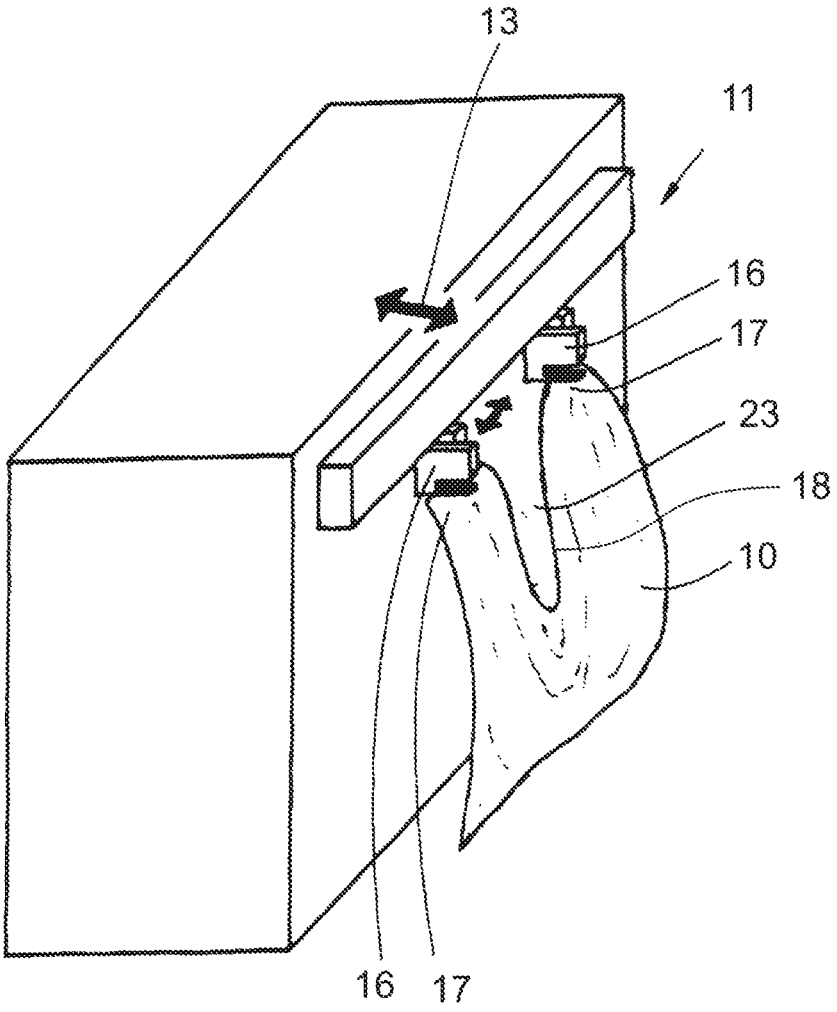
FIG. 1 shows a three-dimensional view of an insertion machine.

In the exemplary embodiment of FIGS. 1 and 2, the clamp mouths 19 are slightly inclined, and therefore they rise somewhat in the feeding direction 13. It is also conceivable for the clamp mouths 19 of the spreading clamps 16 to be oriented horizontally.

By means of the elongate clamp mouths 19, the spreading clamps 16 hold an edge region emerging from the front edge 18, in particular edge strip 20 running transversely with respect to the feeding direction 13, of the respective item of laundry 10.

The spreading clamps 16 of a respective pair of spreading clamps are carried by moving carriages 21 which can be brought together and moved apart on and along a horizontal rail 22 running transversely with respect to the feeding direction 13. When the spreading clamps 16 are brought together, the corners 17 or corner regions of the front edge 18 of the item of laundry 10 are inserted into the clamp mouths 19 of said spreading clamps or are accepted from the latter. When the spreading clamps 16 are moved together, there is a still relatively large sag 23 of the front edge 18 of the item of laundry 10 between them. By the spreading clamps 16 being moved apart, the front edge 18 of the item of laundry 10 is stretched out and/or spread and, in the process, the item of laundry 10 is spread out.

In order not to expose the item of laundry 10, in particular the front edge 18 thereof, to excessive mechanical loads as it is being stretched out, the spreading clamps 16 are moved apart only until the front edge 18 still has a, if only slight, residual sag 24. The lowest point of the front edge 18, which point is located approximately in the center between the moved-apart spreading clamps 16, is located at a vertical distance 25 under an imaginary horizontal connecting line 26 through the clamp mouths 19 of the two spreading clamps 16 of the respective pair of spreading clamps.

As a result of the elongate clamp mouths 19, running in the feeding direction 13, of the spreading clamps 16, the edge strip 20 which sags by the residual sag 24 precisely in the same manner as the front edge 18 of the stretched-out item of laundry 10 is formed between the moved-apart spreading clamps 16. Therefore, not only the front edge 18, but also the edge strip 20, sags between the moved-apart spreading clamps 16.

The depositing strip 27 runs transversely with respect to the feeding direction 13 and therefore parallel to the spreading device 11. The depositing strip 27 is arranged downstream of the spreading device 11 in the feeding direction 13. The depositing strip 27 has a depositing table 28. At least said depositing table 28 of the depositing strip 27 extends over the entire working width of the apparatus, and in particular is of such a width that it at least corresponds to the width or length of the front edge 18 of the largest items of laundry 10. A front part of an upper side of the depositing table 28 forms a depositing region 29 for the stretched-out edge strip 20 of the item of laundry 10. At least said depositing region 29 can be designed for pneumatically fixing the edge strip 20. For example, for this purpose, the depositing region 29 is air-permeable and can be subjected to negative pressure from the interior of the depositing table 18.

The depositing table 28 of the depositing strip 27 is pivotable about a horizontal pivot axis 30 and is movable along a preferably horizontal path in and counter to the feeding direction 13 between the spreading device 11 and the feed conveyor 12, in particular the first belt conveyor 14 of same. For this purpose, the depositing strip 27 has a slide 31 which is movable by a corresponding drive along at least one, preferably horizontal, rail 32 running in the feeding direction 13. In addition, the depositing table 28 is pivotable about the pivot axis 30 in relation to the slide 31 by at least one pressure medium cylinder 33 (cf. FIGS. 2, 3 and 5). Alternatively, it is also conceivable to move the depositing table 28 up and down under the slide 31 and/or to lift or lower the depositing table 28 under the slide 31. By pivoting or lifting or lowering the depositing table 28, the distance of the depositing table 28, in particular its depositing region 29, from the lower side of the spreading clamps 16 can be increased. As a result, with greater distance from the spreading clamps 16, at least the depositing region 29 of the depositing table 28 can be moved under the spreading clamps 16 (FIG. 2). In order to accept the sagging edge strip 20 delimited by the front edge 18 of the item of laundry 10, said increased distance can be changed until the depositing region 29 is located closely below the lowest point of the residual sag 24 (FIG. 2).

Figure 4:
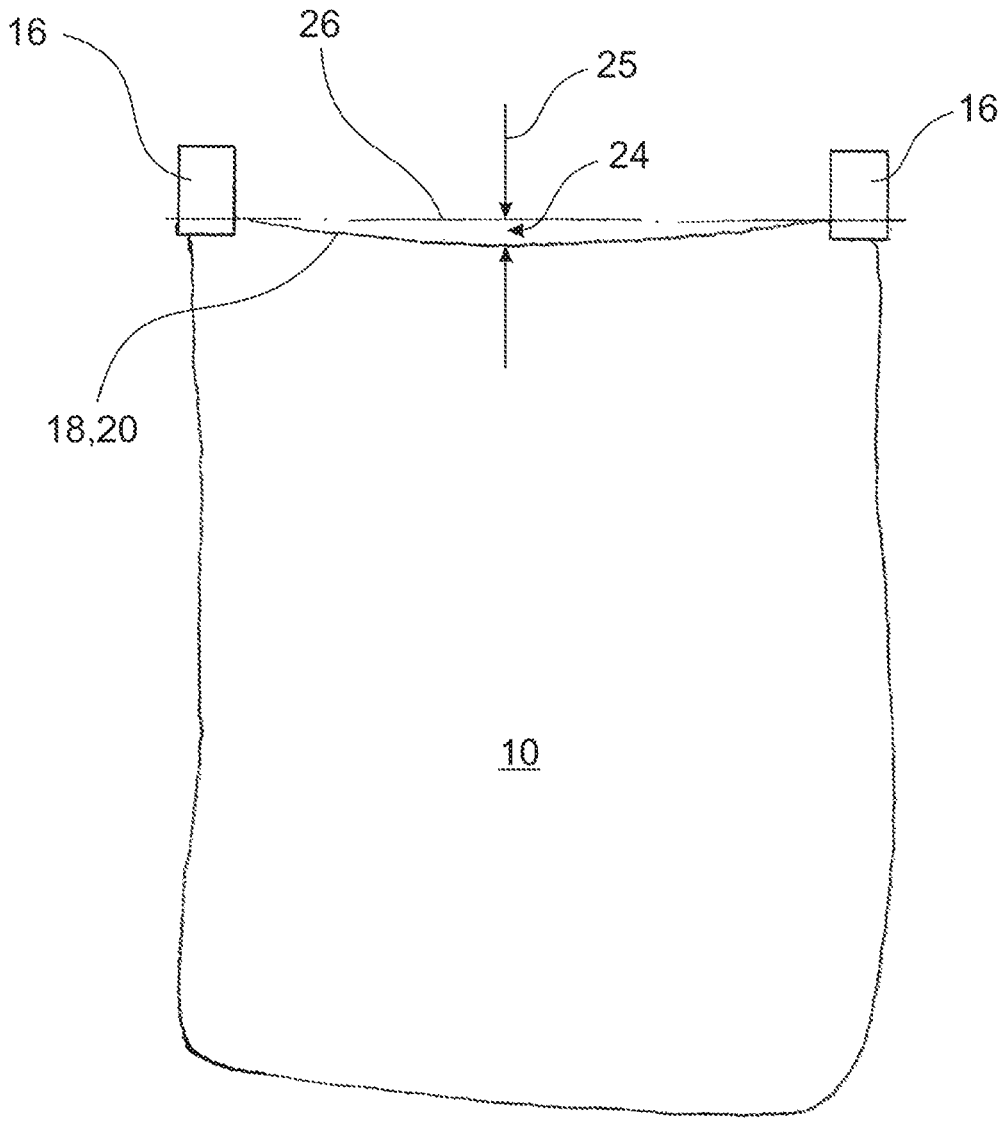
FIG. 4 shows a schematic front view of an item of laundry which is stretched out by the spreading clamps and has a residual sag.

FIG. 4 shows the item of laundry 10 spread out by the spreading clamps 16 of the spreading device 11. The residual sag 24 of the front edge 18 and of the edge strip 20, emerging therefrom, of the item of laundry 10 can be seen as can the distance 25 of the lowest (central) point of the residual sag 24 from an imaginary connecting line 26 between the spreading clamps 16.

After the edge strip 20 of the item of laundry 10 is accepted, the depositing strip 27, which has again been pivoted upward or moved upward for this purpose, is movable in the feeding direction 13 toward the mangle or another laundry treatment machine. The movement distance here is of such a size that the depositing strip 27 passes over the feed conveyor 12, in particular the frontmost belt conveyor 14 of same, wherein a free transverse edge 34 of the depositing table 28, said free transverse edge facing the spreading device 11, passes closely over an upper strand 35 of the feed conveyor 12, in particular the belt conveyor 14 thereof. In the process, the depositing strip 27 is in a depositing position of the edge strip 20 of the item of laundry 10 onto the upper strand 35 (FIG. 3).

The method according to the invention is explained below with reference to the apparatus shown by way of example in the figures, in particular insertion machine.

The method according to the invention involves the feeding of items of laundry 10 to a mangle or to another laundry treatment machine, for example a folding machine. This feeding takes place with the apparatus which is shown in FIGS. 1 to 3 and is referred to in technical jargon as an insertion machine.

The item of laundry 10 is spread out by the spreading device 11 of the apparatus. The spread-out item of laundry 10 is then deposited on the depositing strip 27 which transfers it to the feed conveyor 12, in particular deposits it thereon with the edge strip 20. The feed conveyor 12 then transports the spread-out item of laundry 10 to the mangle or the like and inserts it into the latter.

The item of laundry 10 to be spread out by the spreading device 11 is inserted at adjacent corners 17 of the front edge 18, which runs transversely with respect to the feeding direction 13, into moved-together spreading clamps 16 of a pair of spreading clamps. This insertion can take place in a mechanized or manual manner. Especially during manual insertion, the corner 17 is inserted more or less exactly into clamp mouths 19 of the spreading clamps 16. It may happen here that it is adjacent regions rather than exactly the corners 17 which are inserted into the clamp mouths 19. Then, corner regions rather than exactly the corners 17 are located in the spreading clamps 16. When corners 17 are referred to below, this includes corner regions of the respective item of laundry 10.

After the item of laundry 10 is hooked into the moved-together spreading clamps 16 (FIG. 1), the front edge 18 of the item of laundry 10 still has a relatively large sag 23. This sag 23 is reduced by the spreading device 11, by the spreading clamps 16 of the respective pair of spreading clamps being moved apart. In order to protect the items of laundry, the spreading clamps 16 are, however, moved apart only until the front edge 18 still has a small residual sag 24. The lowest point of said residual sag 24 lies in the center or at least approximately in the center between the spreading clamps 16 of the pair of spreading clamps, specifically below the imaginary connecting line 26 between the spreading clamps 16 or the adjacent corners 17 of the front edge 18 of the item of laundry 10. The maximum residual sag 24 then lies at the distance 25 under the imaginary rectilinear horizontal connecting line 26 (FIG. 4).

Figure 5:
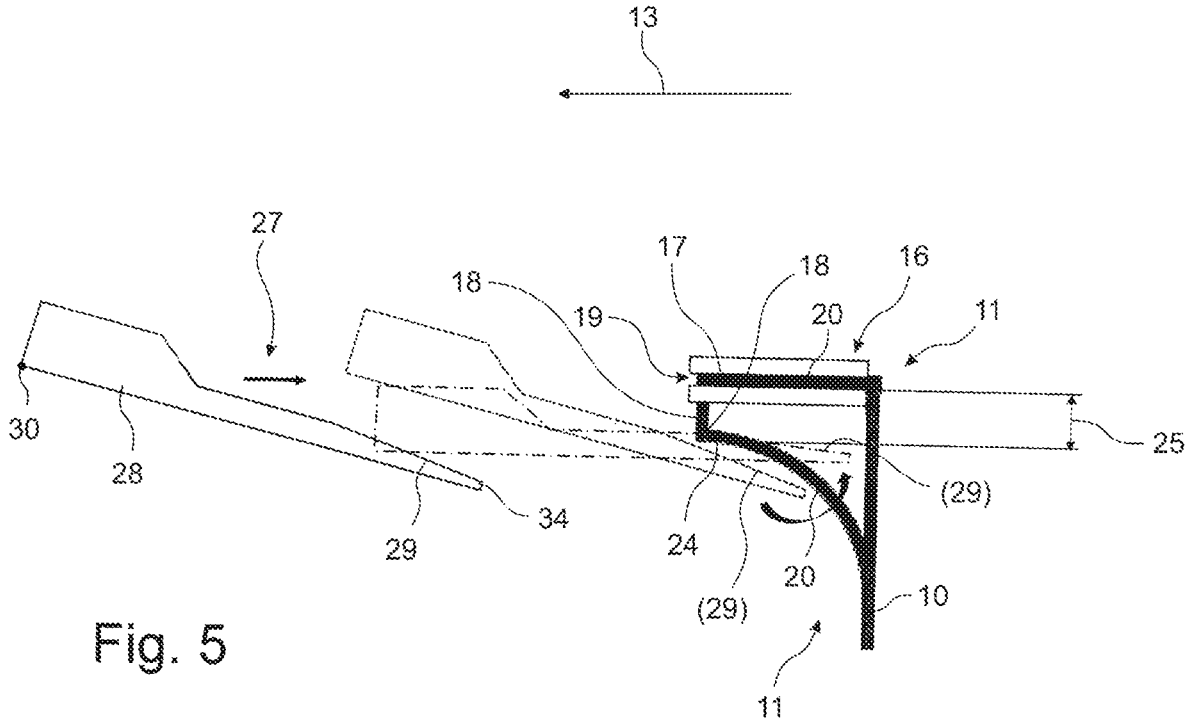
FIG. 5 shows a schematic illustration of the movement sequences of the depositing strip during the accepting of the edge strip of the item of laundry from the spreading clamps.

As a result of the corners 17 or the adjacent corner regions of the front edge 18 of the item of laundry 10 being pushed into the elongate clamp mouths 19, running in the feeding direction 13, of the spreading clamps 16, an edge strip 20 emerging from the front edge 18 is formed between the spreading clamps 16 of the respective pair of spreading clamps. In FIGS. 2 and 3, the clamp mouths 19 which are open at the front rise slightly in the direction of the feed conveyor 12 or of the depositing strip 27. Alternatively, however, the clamp mouths 19 can also run horizontally, as is shown in FIG. 5. The edge strip 20 then runs horizontally. As a result of the residual sag 24 of the front edge 18 of the item of laundry 10 spread out by the spreading clamps 16, the edge strip 20 preferably also sags correspondingly approximately in the center and is also at the distance 25 from the connecting line 26 or from a rectilinear horizontal or slightly rising connecting plane between the spreading clamps 16. When the edge strip 20 of the item of laundry 10 is accepted from the depositing region 29 of the depositing strip 27 or when it is transferred onto the depositing region 29 of the depositing strip 27, the residual sag 24 or the distance 25 interferes if, for this purpose, the depositing region 29 of the depositing strip 27 is moved under the edge strip 20 (FIG. 2). In particular, during the transfer of the edge strip 20 onto the depositing region 29 of the depositing strip 27, there is the risk that the front edge 18 and preferably also the edge strip 20 are pushed back counter to the feeding direction 13, especially in the region of the lowest point of the residual sag 24, as a result of which the front edge 18, when it lies on the depositing region 29, does not run, as sought, rectilinearly or at least virtually rectilinearly, but in an arc-shaped manner, which would impair the quality of the mangling or folding quality of the item of laundry 10.

According to the invention, provision is now made for at least a front part of the depositing strip 27, in particular the depositing region 29 of the depositing strip 27, to pivot downward or to be lowered before the edge strip 20 of the item of laundry 10, which edge strip is still held with the residual sag 24 by the spreading clamps 16, moves downward. As a result, the distance at least of the depositing region 29 of the depositing strip 27 from the spreading clamps 16 is temporarily increased. Consequently, the depositing region 29 passes to such an extent, in particular depth, under the edge strip 20, in particular the lowest point thereof in the region approximately in the center of the residual sag 24, that the depositing point 29 can be moved under the edge strip 20, which is still somewhat sagging, without touching the edge strip 20 and the front edge 18 of the item of laundry 10. This distance is preferably increased until it is larger than the maximum distance 25, to be anticipated even for larger items of laundry 10, in the region of the lowest point of the sag 24 from the imaginary rectilinear connecting line 26. It is thus ensured that, in the case of items of laundry 10 of any size, the depositing strip 27, in particular its depositing region 29, does not collide with the lowest point of the edge strip 20 having the respective residual sag 24, in particular does not touch the lowest point of the residual sag 24 of the front edge 18 of the item of laundry 10.

As soon as the depositing strip 27, in particular its depositing region 29, has moved completely under the edge strip 20, sagging in the center, of the item of laundry 10, the depositing table 28 is pivoted upward about its pivot axis 30 or the entire depositing strip 27 is moved upward. This takes place at least until the lowest point of the residual sag 24 rests on the depositing region 29, but preferably until the residual sag 24 of the front edge 18 and/or of the edge strip 20 has been eliminated and in particular the entire edge strip 20 lies on the depositing region 29 of the depositing strip 27 and/or on the imaginary connecting line 26 or the rectilinear connecting surface between the clamp mouths 19 of the spreading clamps 16. The edge strip 20 is then located on the depositing region 29 of the depositing table 28 in such a manner that the front edge 18 of the item of laundry 10 runs rectilinearly or at least approximately rectilinearly, wherein the deviation from the rectilinear profile corresponds at maximum to the distance 25, and is preferably smaller than the distance 25.

After the edge strip 20 is lying in the above-described manner ideally rectilinearly on the depositing region 29 of the depositing table 28, the edge strip 20 is preferably fixed on the depositing region 29 pneumatically by, for example, suction. The spreading clamps 16 are then released from the corners 17 or corner regions by opening of the clamp mouths 19 and, for example, moving apart of the spreading clamps 16 such that the clamp mouths 19 release the corners 17 or the corner regions of the item of laundry 10.

Subsequently, the depositing table 28 is moved in the feeding direction 13 to the feed conveyor 12, in particular to the front belt conveyor 14 and over same, and the edge strip 20 is deposited on the feed conveyor 12, in particular on the belt conveyor 14, specifically on the upper strand 25 thereof.

The edge strip 20 can be deposited from the depositing strip 27 onto the feed conveyor 12 in the position in which the edge strip 20 has been deposited on the depositing region 29 of the depositing strip 27. This is the same position which corresponds to the upwardly pivoted or raised position of the depositing strip 27 after moving down under the edge strip 20, which is still held in the spreading clamps 16. In this case, just before the depositing region 29 of the depositing strip 27 is moved down again under the sagging edge strip 20 of the next item of laundry 10, the depositing table 28 with its front depositing region 29 is either pivoted downward, or alternatively the entire depositing table 28 is lowered, in order to increase the distance from the spreading clamps 16 and/or the edge strip 20.

It is alternatively also conceivable for the pivoting downward or lowering of the depositing region 29 and/or the depositing strip 27 to already take place for depositing the edge strip 20 from the depositing strip 27 onto the upper strand 35 of the feed conveyor 12, in particular of the first belt conveyor 14 thereof. In said pivoted downward or lowered position, the depositing strip 27 can then be immediately moved under the sagging edge strip 20 of the next item of laundry 10, specifically at the increased distance according to the invention from the spreading clamps 16 and/or from the sagging edge strip 20, which is held in the spreading clamps 16, without touching said edge strip 20.

LIST OF REFERENCE SIGNS

10 item of laundry
11 spreading device
12 feed conveyor
13 feeding direction
14 belt conveyor
15 belt conveyor
16 spreading clamp
17 corner
18 front edge
19 clamp mouth
20 edge strip
21 moving carriage
22 rail
23 sag
24 residual sag
25 distance
26 connecting line
27 depositing strip
28 depositing table
29 depositing region
30 pivot axis
31 slide
32 rail
33 pressure medium cylinder
34 transverse edge
35 upper strand

What is claimed is:

1. A method for feeding items of laundry (10) to a mangle, with two adjacent corner regions of a front edge (18), running transversely with respect to the feeding direction (13), of the respective item of laundry (10) being clamped in two adjacent spreading clamps (16) of a spreading device (11), the front edge (18) being stretched out by the spreading clamps (16) holding the adjacent corner regions being moved apart and, in the process, the item of laundry (10) being spread out and the item of laundry (10), with an edge strip (20) emerging from the stretched-out front edge (18), being accepted onto a depositing region (29) of a depositing strip (27), which is movable in and counter to the feeding direction (12) and which transfers the item of laundry (10) to a feed conveyor (12) transporting the item of laundry (10) to the mangle, wherein in order to accept the respective item of laundry (10) from the spreading clamps (16), at least one portion of the depositing strip (27) is moved at a distance under at least the edge strip (20) of the item of laundry (10), wherein the depositing strip is moved under the edge strip (20) at a vertical distance from a furthest sagging region of the edge strip (20) of the respective item of laundry (10).

2. The method as claimed in claim 1, wherein, after moving down at least part of the depositing strip (27) under the sagging edge strip (20), at least that part of the depositing strip (27) that is located under the edge strip (20) is raised until the sag of the edge strip (20) is eliminated.

3. A method for feeding items of laundry (10) to a mangle, with two adjacent corner regions of a front edge (18), running transversely with respect to the feeding direction (13), of the respective item of laundry (10) being clamped in two adjacent spreading clamps (16) of a spreading device (11), the front edge (18) being stretched out by the spreading clamps (16) holding the adjacent corner regions being moved apart and, in the process, the item of laundry (10) being spread out and the item of laundry (10), with an edge strip (20) emerging from the stretched-out front edge (18), being accepted onto a depositing region (29) of a depositing strip (27), which is movable in and counter to the feeding direction (12) and which transfers the item of laundry (10) to a feed conveyor (12) transporting the item of laundry (10) to the mangle, wherein in order to accept the respective item of laundry (10) from the spreading clamps (16), at least one portion of the depositing strip (27) is moved at a distance under at least the edge strip (20) of the item of laundry (10), wherein the depositing strip (27) is moved at such a distance counter to the feeding direction (13) under the edge strip (20) of the item of laundry (10) that the lowest point of the front edge still having a residual sag (24) after being stretched out and of the sagging edge strip (20) emerging from the latter is not touched by the depositing strip (27).

4. A method for feeding items of laundry (10) to a mangle, with two adjacent corner regions of a front edge (18), running transversely with respect to the feeding direction (13), of the respective item of laundry (10) being clamped in two adjacent spreading clamps (16) of a spreading device (11), the front edge (18) being stretched out by the spreading clamps (16) holding the adjacent corner regions being moved apart and, in the process, the item of laundry (10) being spread out and the item of laundry (10), with an edge strip (20) emerging from the stretched-out front edge (18), being accepted onto a depositing region (29) of a depositing strip (27), which is movable in and counter to the feeding direction (12) and which transfers the item of laundry (10) to a feed conveyor (12) transporting the item of laundry (10) to the mangle, wherein in order to accept the respective item of laundry (10) from the spreading clamps (16), at least one portion of the depositing strip (27) is moved at a distance under at least the edge strip (20) of the item of laundry (10), wherein, after moving the depositing strip (27) counter to the feeding direction (13) under the edge strip (20) of the item of laundry (10), a residual sag (24) of the edge strip (20) of the item of laundry (10) is at least for the most part eliminated.

5. The method as claimed in claim 4, wherein, after moving the depositing strip (27) counter to the feeding direction (13) under the edge strip (20) of the item of laundry (10), the vertical distance at least of a depositing region (29) of the depositing strip (27) from the edge strip (20) of the item of laundry (10) is eliminated by raising at least the depositing region (29) of the depositing strip (27).

6. The method as claimed in claim 4, wherein, after moving the depositing strip (27) counter to the feeding direction (13) under the edge strip (20) of the item of laundry (10), the vertical distance of the depositing strip (27) from the edge strip (20) is reduced at least until the entire edge strip (20) rests on the depositing strip (27).

7. The method as claimed in claim 6, wherein the vertical distance of at least the depositing region (29) of the depositing strip (27) from the edge strip (20) is changed by lifting or lowering at least the depositing region (29) of the depositing strip (27).

8. The method as claimed in claim 6, wherein the vertical distance of at least the depositing region (29) of the depositing strip (27) from the edge strip (20) is changed by pivoting at least the depositing region (29) of the depositing strip (27).

9. The method as claimed in claim 8, wherein the pivoting of the depositing strip (27) takes place about a horizontal pivot axis (30) which, as seen in the feeding direction (13), follows the depositing region (29).

10. The method as claimed in claim 8, wherein the pivoting of the depositing strip (27) takes place about a pivot axis (30) which lies at or in the vicinity of an end of the depositing strip (27) opposite the spreading device (11), and runs transversely with respect to the feeding direction (13).

11. The method as claimed in claim 1, wherein, once the edge strip (20) of the item of laundry (10) has been completely deposited onto the depositing region (29) of the depositing strip (27), the depositing strip (27), while maintaining the position in which it has accepted the edge strip (20), is moved together with the item of laundry (10) in the feeding direction (13).

12. The method as claimed in claim 11, wherein, once the edge strip (20) of the item of laundry (10) has been deposited onto the depositing region (29) of the depositing strip (27), while maintaining the position in which the depositing strip (27) has accepted the edge strip (20), the depositing strip (27) is moved with the item of laundry (10) in the feeding direction (13) and the item of laundry (10) is subsequently transferred from the depositing strip (27) onto the feed conveyor (12).

* * * * *